US007387226B2

(12) United States Patent
Porter

(10) Patent No.: US 7,387,226 B2
(45) Date of Patent: Jun. 17, 2008

(54) TRIPLE STRAP CARRYING SYSTEM FOR A GOLF BAG

(75) Inventor: Tyler Porter, West Henrietta, NY (US)

(73) Assignee: Izzo Golf Inc., Macedon, NY (US)

( * ) Notice: Subject to any disclaimer, the term of this patent is extended or adjusted under 35 U.S.C. 154(b) by 233 days.

(21) Appl. No.: 11/219,961

(22) Filed: Sep. 6, 2005

(65) Prior Publication Data

US 2007/0051762 A1 Mar. 8, 2007

(51) Int. Cl.
*A45F 3/04* (2006.01)
*A45F 3/02* (2006.01)

(52) U.S. Cl. ..... 224/259; 224/264; 224/576; 224/580; 206/315.3

(58) Field of Classification Search ..... 224/259, 224/580, 264, 576; 206/315.3
See application file for complete search history.

(56) References Cited

U.S. PATENT DOCUMENTS

| | | | | |
|---|---|---|---|---|
| 2,820,498 | A | 1/1958 | Endee | |
| 5,038,984 | A | 8/1991 | Izzo | |
| 5,042,703 | A | 8/1991 | Izzo | |
| 5,042,704 | A | 8/1991 | Izzo | |
| 5,269,449 | A * | 12/1993 | Sattler | 224/258 |
| 5,356,003 | A * | 10/1994 | Gretz et al. | 206/315.7 |
| 5,429,288 | A | 7/1995 | Sattler | |
| 5,558,259 | A | 9/1996 | Izzo | |
| 5,593,077 | A | 1/1997 | Izzo | |
| 5,636,778 | A | 6/1997 | Jones et al. | |
| D411,039 | S | 6/1999 | Reimers et al. | |
| D411,666 | S | 6/1999 | Reimers et al. | |
| D412,396 | S | 8/1999 | Reimers et al. | |
| 5,979,727 | A | 11/1999 | Steurer | |
| 6,006,974 | A | 12/1999 | Varney et al. | |
| 6,131,783 | A | 10/2000 | Maeng | |
| 6,152,343 | A * | 11/2000 | Shin | 224/645 |
| 6,305,535 | B1 | 10/2001 | Fair | |
| 6,457,620 | B1 | 10/2002 | Batten et al. | |
| 6,460,747 | B1 | 10/2002 | Tuerschmann et al. | |
| D488,619 | S | 4/2004 | Klock | |
| 2002/0113105 | A1 | 8/2002 | Jarman | |
| 2003/0075464 | A1 * | 4/2003 | Shin | 206/315.5 |

(Continued)

FOREIGN PATENT DOCUMENTS

FR 2819192 A1 * 7/2002

*Primary Examiner*—Nathan J Newhouse
*Assistant Examiner*—Jack H Morgan, Jr.
(74) *Attorney, Agent, or Firm*—Neal L. Slifkin

(57) ABSTRACT

A golf bag carrying system, in the form of a triple strap carrier, includes a first and a second strap secured to the golf bag to define first and second shoulder openings, respectively. The first strap second end and the second strap first end are attached to a first ring, and the second strap is led through a second ring at a central (second) location at a mid-portion of the bag. The other ends of the first and second straps are secured to the golf bag longitudinally on opposite sides of the second location at first and third locations, respectively. A third strap is attached to the first ring and to the bag at a fourth location below the third location. The mounts for securing the straps to the bag, and the straps themselves, preferably are selectively adjustable to balance the bag in single-shoulder and dual-shoulder carrying modes.

6 Claims, 3 Drawing Sheets

U.S. PATENT DOCUMENTS

2003/0121942 A1 7/2003 Chang
2004/0089686 A1 5/2004 Pratt et al.
2004/0144820 A1 7/2004 Herold
2004/0206793 A2 10/2004 Enes

* cited by examiner

TRIPLE STRAP CARRYING SYSTEM FOR A GOLF BAG

TECHNICAL FIELD

The present invention relates to strap apparatus for depending a golf bag from one or more shoulders of an upright human; more particularly, to strap apparatus capable of depending a golf bag from both shoulders of a human simultaneously; and most particularly, to a strap apparatus capable of depending a golf bag electably from either shoulder individually or from both shoulders simultaneously.

BACKGROUND OF THE INVENTION

The game of golf is one of the most widely enjoyed sports activities in the world. The number of persons participating in this activity, both at the professional and recreational level, is almost unparalleled. Not only is this activity already widespread, but also the ranks of golfers continue to swell at an unprecedented rate.

The sport of golf is typically played on a course consisting of nine or eighteen "holes". A set of clubs is used to strike a golf ball along each hole comprising the course. Each hole consists of a starting location wherein a golfer places a ball and initially strikes the ball towards a green. Each green includes a recessed cup, and it is the object of the golfer to strike the ball with a series of strokes into the cup. Different clubs are used to vary the height, distance and spin of the ball, and a set of clubs may number ten or more. The holes normally vary in length from short holes of approximately one hundred yards to longer holes of five hundred yards and greater. The holes are flanked by rough areas out of which it is more difficult to play, and hazards are provided to increase the intricacy and precision required in play.

Golfers may travel over a course during play in a variety of manners. For example, a golfer may walk a course and carry his/her clubs in a specialized container known in the art as a "golf bag" or sometimes employs another to carry clubs for him/her. Other golfers employ wheeled pull carts which mountably receive a set of clubs with or without a golf bag so that a golfer may push or pull the cart as the golfer walks each hole. Motorized or engine driven carts are available at some courses and, in fact, are required for play at certain courses, wherein a golfer mounts his/her clubs on the motorized cart and drives across the course from one ball lie to the next.

The present invention concerns those persons who walk a golf course and carry their own clubs in a golf bag. This invention is thus useful for a substantial number of golfers who desire walking a golf course as a means of healthy, enjoyable exercise. One of the drawbacks which has long existed for these golfers prior to the present invention, however, is the nature of the construction of the standard golf bag. A typical golf bag which receives the set of clubs is in the form of a tubular body enclosed at one end. A single strap extends from an upper rim of the golf bag to a mid-point on the bag. The golfer or the caddy then carries such bag by inserting one arm through the strap so that the strap extends across one shoulder thus supporting the bag for travel. A small handle may also be mounted on the bag, normally between the end points of the strap, to enable the bag to be carried by the human hand.

A disadvantage to this system has long been present, in that the entire weight of the golf clubs and bag, which may typically be on the order of twenty to twenty-eight pounds, can strain the muscles of the neck and shoulders. Despite this disadvantage, some golfers still enjoy being able to carry their golf bag and clubs slung over either shoulder individually.

In U.S. Pat. No. 5,042,704, relevant disclosure of which is herein incorporated by reference, a golf bag carrying system is disclosed in the form of a dual strap carrier device that may be manufactured either in conjunction with the construction of a golf bag, as original equipment, or which may be manufactured as a retro-fit system attachable to a standard golf bag assembly. The disclosed device enables a golfer to carry a golf bag and clubs suspended from both shoulders simultaneously. To this end, in its broad form, the disclosed system is in the form of a strap assembly for use with a golf bag wherein the golf bag is in the form of an elongated tubular member having a surrounding sidewall, an enclosed end and an open end whereby the shafts of golf clubs made be inserted into the golf bag. The strap assembly includes a first strap having a first strap end secured to the golf bag at a first location proximate the open end and having a first strap second end secured to the golf bag at a second location axially spaced from the first location along an attachment axis. The first strap thereby defines a primary strap forming a first strap opening which may be secured over one of the person's shoulders. The second strap has a second strap first end secured to the golf bag proximate the second location and has a second strap second end secured to the golf bag at a third location axially spaced from the second location along the attachment axis between the second location and the closed end of the golf bag, thereby defining a second strap opening. The second strap thus forms a secondary strap opening which may be positioned over the other shoulder of the person so that the golf bag may be suspended from and supported by both shoulders in a fully supported state. In the fully supported state, therefore, the golf bag is oriented generally transversely across the back of the user.

The system disclosed in U.S. Pat. No. 5,042,704 is said to be useful in carrying a golf bag over either one shoulder or both shoulders, according to the desires of the carrier. However, experience shows that the primary strap opening optimal for single-shoulder use is different from that which is optimal for dual-shoulder use; and further, that when the attachment means at the second location is a ring, the straps can slide through the ring, permitting the primary strap opening to become substantially oversized; and further, that a second location which is optimal for dual-shoulder use is sub-optimal for single-shoulder use, resulting in a cumbersome single-shoulder carrying mode.

Thus, what is needed in the art is a carrying system for a golf bag that can be adjusted to be simultaneously optimum for either single-shoulder carrying or dual-shoulder carrying.

What is further needed is such a system wherein no readjustment of the system is required to shift from one carrying mode to the other.

What is further needed is such a system wherein a carrier may shift from one carrying mode to the other without having to set down the golf bag.

It is a principal object of the present invention to provide means for carrying a golf bag on either a single shoulder or on both shoulders, wherein the adjustments for both carrying modes may be simultaneously optimized.

SUMMARY OF THE INVENTION

Briefly described, a golf bag carrying system in accordance with the invention comprises a triple strap harness, including a first strap and a second strap secured to the golf bag along a longitudinal axis to define first and second arm shoulder openings, respectively. The first strap second end and the second strap first end are attached to a first ring not secured to the bag. The second strap is led through a second ring secured to the bag at a mid-portion of the bag at a central (second) location. The other ends of the first and second straps are secured to the bag longitudinally on opposite sides of the second location at first and third locations, respectively, as in the prior art. A third strap is attached to the first ring and to the bag at a fourth location between the third location and the closed end of the bag. The lengths of the first, second, and third straps, and the positions of the first, second, third, and fourth mounts for securing the straps to the bag, may be selectively adjustable to balance the bag in both single-shoulder and dual-shoulder carrying modes.

BRIEF DESCRIPTION OF THE DRAWINGS

The present invention will now be described, by way of example, with reference to the accompanying drawings, in which.

DESCRIPTION OF THE PREFERRED EMBODIMENTS

The present invention is directed to a golf bag assembly that uses a new and useful strap assembly enabling a golfer or other person to conveniently carry a golf bag on either of single shoulders or on both shoulders, without making adjustment to the assembly or setting down the golf bag. In the broad form, the present invention is described either as a strapping assembly that may be manufactured as original equipment on a golf bag or which may be manufactured separately as a retro-fit attachment to existing golf bags.

Figure 1:
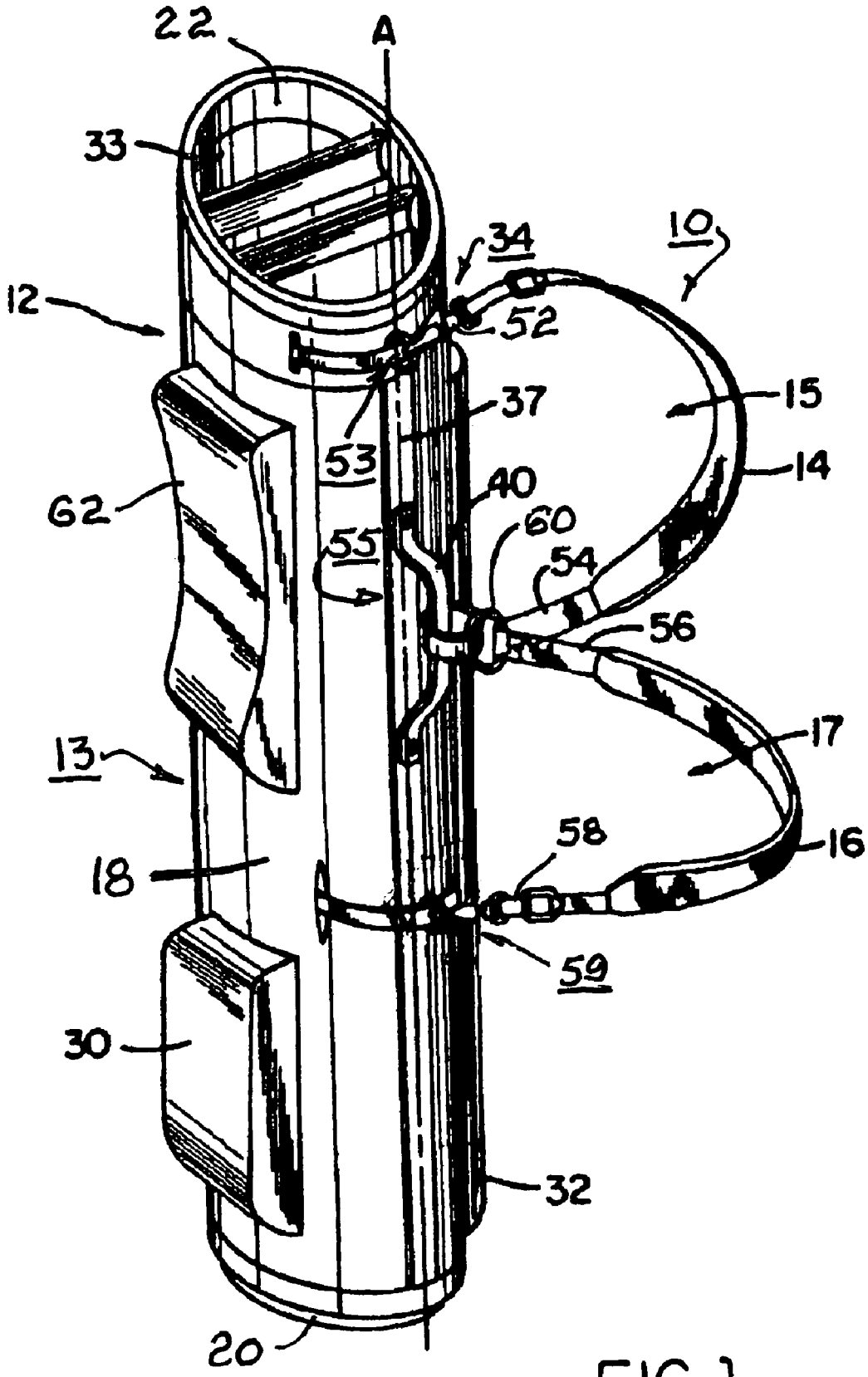
FIG. 1 is a perspective view of a golf bag equipped with a dual-strap carrying system in accordance with the prior art, as disclosed in U.S. Pat. No. 5,042,704.

In FIG. 1, a golf bag 12 in accordance with a prior art dual-strap carrying system 10, such as is disclosed in U.S. Pat. No. 5,042,704, comprises a first strap 14 and a second strap 16. Golf bag 12 is in the form of an elongated tubular body 13 having a surrounding sidewall 18, a closed end 20 and an open end 22 so that set of golf clubs (not shown) may be inserted in golf bag 12 for storage and transport. Auxiliary compartments 30 and 32 are provided to permit transport of auxiliary golf equipment and are oriented to permit balancing of the weight of the golf bag and clubs.

Golf bag 12 has a central handle 40 located at a mid-portion of golf bag 12. First strap 14 defines a primary strap and has a first strap first end 52 which is secured to golf bag 12 at a first location 53 along an upper end portion 34 adjacent open end 22. A second end 54 of first strap 14 is secured to golf bag 12 at a second location 55 along a mid-portion thereof, and, to this end, second end 54 is secured to handle 40 via a ring 60, defining a primary shoulder opening 15. Second strap 16 has a first end 56 secured to a mid-portion of golf bag 12, specifically to handle 40 via ring 60, and second strap 16 has a second end 58 secured to golf bag 12 at a third location 59 longitudinally spaced from the point of attachment of ends 54 and 56 toward closed end 20 of golf bag 12 defining a secondary shoulder opening 17. Thus, as shown in FIG. 1, the first, second and third locations 53,55,59 define longitudinal attachment points. A wedge-shaped structure 33 is mounted in open end 22 diametrically opposite axis A and operates to help prevent inadvertent dislodgment of golf clubs from golf bag 12 during use.

A carrier may carry golf bag 12 by inserting a right arm and shoulder through primary opening 15 and inserting a left arm and shoulder through secondary opening 17. When the bag is hoisted into carrying position, the bag being then diagonally transverse of the carrier's back, the bag rests against the carrier's back on padded saddle 62 with open end 22 extending to the right of the carrier.

First strap second end 54 and second strap first end 57 preferably are joined such that they pass freely through ring 60, permitting automatic equalization of sizes as may be required for first and second openings 15,17 once the bag is in carrying-position. It will be seen that if one attempts to carry bag 12 by inserting only one arm and shoulder (whether left or right) into primary opening 15, the weight of the bag and clubs will cause secondary strap 16 to be drawn through ring 60, resulting in a primary opening that is very large and in which the golf bag is very badly balanced. Thus it is impractical to carry a golf bag using only one shoulder, when using prior art dual-strap carrying system 10.

Figure 2:
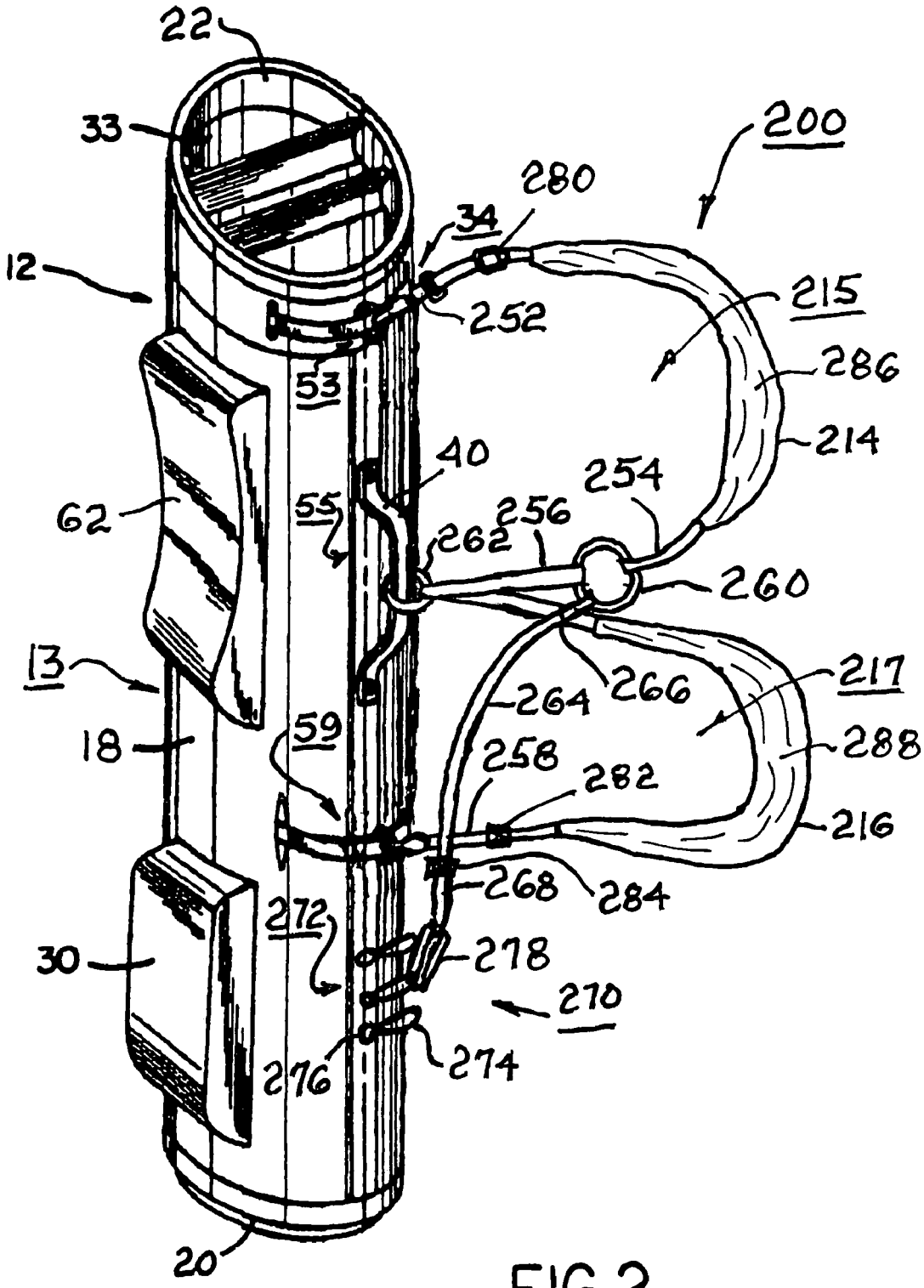
FIG. 2 is a perspective view of a golf bag equipped with a triple-strap carrying system in accordance with the invention, showing the straps positioned for dual-shoulder carrying mode.
Figure 3:
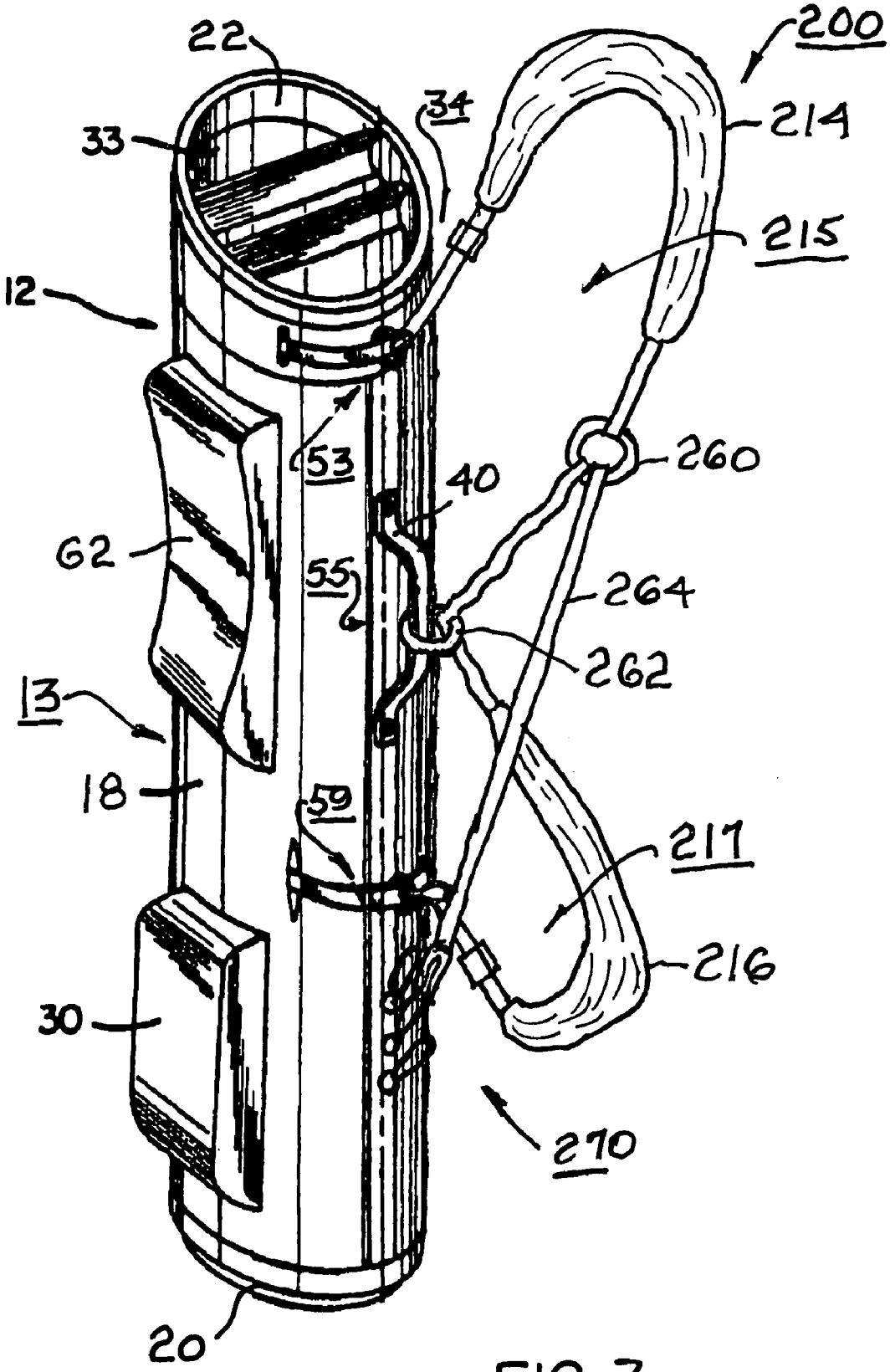
FIG. 3 is a perspective view of a golf bag equipped with a triple-strap carrying system in accordance with the invention, showing the straps positioned for single-shoulder carrying mode.

Referring to FIGS. 2 and 3, items identical with those shown in FIG. 1 bear identical item numbers and need not be repeated here. Items in accordance with the invention carry item numbers in the 200 series.

Referring to FIG. 2, an improved triple-strap carrying system 200 in accordance with the invention is shown in dual-shoulder carrying mode. System 200 comprises a first strap 214 and a second strap 216. Golf bag 12 has a central handle 40 located at a mid-portion 55 of golf bag 12. First strap 214 defines a primary strap and has a first strap first end 252 which is secured to golf bag 12 at first location 53 along an upper end portion 34 adjacent open end 22. The attachment may be made using the circumferential mounting strap as described in U.S. Pat. No. 5,042,704. A second end 254 of first strap 214 is secured to a first ring 260, defining a first primary shoulder opening 215 for a carrier's right shoulder, as in the prior art. Second strap 216 has a first end 256 secured to first ring 260, and second strap 216 has a second end 258 extended through a second ring 262 on or near handle 40 at second location 55 and secured to golf bag 12 at third location 59 longitudinally spaced from the point of attachment of ends 54 and 56 toward closed end 20 of golf bag 12, defining a secondary shoulder opening 217. The second end 258 may also be attached at other locations between the closed end 20 and the open end 22. Thus, as shown in FIG. 2, the first, second, and third locations 53,55,59 are longitudinally spaced from one another. Connection at points 53, 55 and 59 can be made using many attachment methods used in the industry, including rings, D-rings, carabiners or sewing. Other attachment methods are also available.

Primary ring 260 to which first strap second end 254 and second strap first end 256 are attached is preferably larger in diameter than secondary ring 262 and cannot pass through ring 262. Secondary ring 262 could be made in various shapes and need not be circular.

It should be recognized that primary ring 260 is only one means for mutually connecting first, second, and third straps 214,216,264; such mutual connection is generic to the invention and may be accomplished in any convenient manner, such as by stitching them together. Although a ring 260 is shown, alternative hardware of various shapes can be used to connect the straps. An advantage of using a ring or other hardware is that it facilitates first and second straps 214,216 being co-linear in dual-shoulder carrying mode, and first and third straps 214,264 being co-linear in single-shoulder carrying mode.

A third strap 264 has a first end 266 attached to primary ring 260 or other hardware and a second end 268 attached to attachment means 270 on bag 12 at a fourth location 272 between third location 59 and closed bag end 20. Attachment means 270 preferably comprises a plurality of loops 274 attached to bag 12 as by rivets 276 or sewing or any other suitable means and spaced along axis A, and an openable link 278 such as a carabiner connecting strap end 268 to a selected one of loops 274 for optimal balance of bag 12 when carried in single-shoulder mode, as shown in FIG. 3 and described below.

As exemplarily shown in FIGS. 2 and 3, first, second, and third straps 214,216,264 are conjoined by being individually attached to common first ring 260. Hardware other than rings may be used, as will be recognized by those skilled in the art.

All of straps 214,216,264 may be provided with buckle or other means 280,282,284, respectively, for adjusting the length of the straps in conventional fashion to suit an individual carrier. Also, primary and secondary straps 214,216 preferably are provided with broad, padded regions 286,288 to spread and soften the load of the bag and clubs on a carrier's shoulders.

A carrier may carry golf bag 12 in dual-shoulder mode by inserting a right arm and shoulder through primary opening 215 and inserting a left arm and shoulder through secondary opening 217. When the bag is hoisted into carrying position, the bag being then diagonally transverse of the carrier's back, the bag rests against the carrier's back on padded saddle 62, as in the prior art. All of the golf bag load is carried at positions 53,55,59. Third strap 264 does not participate in dual-shoulder carrying and is slack, as shown in FIG. 2, the entire weight of the bag being carried by first and second straps 214,216, as in the prior art.

Referring to FIG. 3, triple-strap carrying system 200 is shown in single-shoulder carrying mode on first strap 214. It will be seen upon comparative examination of FIGS. 2 and 3 that no adjustment of the lengths of any of the three straps 214,216,264 is required to shift the system into single-shoulder mode. When second strap 216 is not used, third strap 264 becomes taut and thus carries the load through first ring 260 with first strap 214. The bag load is thus borne at first and fourth locations 53,272, creating a balanced load. Second strap 216 and second ring 262 do not participate, and second strap 216 is slack.

Obviously, all that is required to shift between single-shoulder and dual-shoulder carrying modes is for the carrier's right arm and shoulder to either engage with or disengage from second strap 216 and second carrying opening 217.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A golf bag for transporting one or more golf clubs, said bag comprising:

a) a body having an open end and a closed end and having four attachment positions spaced apart along a side of said body; and b) a carrying assembly to permit said golf bag to be carried by a human in either single-shoulder or dual-shoulder mode, said carrying assembly including a first strap for use with a first shoulder and having first and second ends, and being attachable at said first end to a first attachment position on said golf bag adjacent said open end to form a first shoulder opening, a second strap for use with a second shoulder and having first and second ends, said first end passing slidably through a second attachment position on said golf bag and being attached to said first strap second end, said second end being attached to a third attachment position on said golf bag, and a third strap having first and second ends, and being attached at said first end to said first strap second end, and being attachable at said second end to a fourth attachment position on said golf bag, wherein said first, second, third, and fourth attachment positions are arranged numerically along an outer surface of said golf bag, and wherein the weight of said golf bag is carried equally on said first and second straps when said first and second straps are deployed on said first and second shoulders, said third strap being slack, and wherein the weight of said golf bag is carried equally on said first and third straps when only said first strap is deployed on only one of said shoulders, said second strap being slack.

2. A golf bag in accordance with claim 1 wherein said attachment means on said golf bag at a second attachment position includes a ring through which said second strap is passed.

3. A golf bag in accordance with claim 1 wherein said fourth attachment position is provided with a plurality of attachment means spaced apart along said side of said body, wherein said second end of said third strap may be selectively attached to any one of said plurality of attachment means spaced apart along said side of said body to provide optimum balance of said bag for a carrier for said single-shoulder carrying mode.

4. A golf bag in accordance with claim 3 wherein said second end of said third strap is connected to a one of said attachment means by a releasable connector to permit changing of attachment from one of said attachment means to another.

5. A golf bag in accordance with claim 3 wherein each of said first strap, said second strap, and said third strap includes means for adjusting the individual length of each strap.

6. A golf bag in accordance with claim 3 wherein at least one of said first and second straps includes a padded region for distributing a load imposed on a shoulder of a golf bag carrier.

* * * * *